United States Patent [19]

Kommrusch

[11] Patent Number: 4,996,188

[45] Date of Patent: Feb. 26, 1991

[54] SUPERCONDUCTING MICROWAVE FILTER

[75] Inventor: Richard S. Kommrusch, Schaumburg, Ill.

[73] Assignee: Motorola, Inc., Schaumburg, Ill.

[21] Appl. No.: 387,548

[22] Filed: Jul. 28, 1989

[51] Int. Cl.[5] ..... H01B 12/00; H01P 1/20

[52] U.S. Cl. ..... 505/1; 333/202; 333/227; 333/995; 505/854; 505/866

[58] Field of Search ..... 333/202, 227-231, 333/99 S; 505/866, 1, 854, 701, 703, 704

[56] References Cited

U.S. PATENT DOCUMENTS

| | | | |
|---|---|---|---|
| 3,818,390 | 6/1974 | Gikow et al. | 333/99 S X |
| 4,215,327 | 7/1980 | McCrea | 333/99 S X |
| 4,857,360 | 8/1989 | Halbritter et al. | 505/866 X |
| 4,872,086 | 10/1989 | Huang et al. | 505/1 X |

OTHER PUBLICATIONS

Zahopoulos et al, "Performance of a Fully Superconducting Microwave Cavity . . . $YiBa_2 Cu_3O_7$", Appl. Phys. Lett. vol. 52, No. 25, Jun. 20, 1988, pp. 2168-2170.

Septier et al, "Microwave Application of Superconducting Materials", Jour. of Physics, vol. 10, 1977, pp. 1193-1207.

Delayen et al, "rf Properties of an Oxide-Superconductor Half-Wave Resonant Line", Appl. Phys. Lett. vol. 52, No. 11, Mar. 14, 1988, pp. 930-932.

*Primary Examiner*—Eugene R. Laroche
*Assistant Examiner*—Seung Ham
*Attorney, Agent, or Firm*—Joseph P. Krause

[57] ABSTRACT

A microwave cavity filter using resonators of superconducting coatings, one-half wavelength long on quartz tubes mounted within the cavity that carry refrigerant to cool the superconductor substantially reduces ohmic losses and permits shrinking the size of conventional cavity filters.

7 Claims, 1 Drawing Sheet

SUPERCONDUCTING MICROWAVE FILTER

BACKGROUND OF THE INVENTION

This invention relates to microwave filters. In particular, this invention relates to cavity filters formed by cylindrical cavities possibly including RF resonators located within the cavities to tune the filter's response.

Prior art ½-wavelength microwave cavity resonators are typically constructed with a ratio between the outer and inner conductors of 3.59 to 1 for optimum Q. Power loss in these filters is a significant problem and is principally attributed to ohmic losses in the inner conductor of the filter. The size of the inner conductor may be increased to reduce ohmic losses. Increaing the inner conductor, however, must be accompanied by an increase in the size of the outer conductor of approximately 3.59 times that of the inner conductor to obtain a Q improvement. On the other hand, ohmic losses in a cavity resonator could be substantially reduced by usage of superconducting materials including new high temperature superconducting materials such as Ytrium-Barium-Copper-Oxide (YBC).

In a normal or typical prior art cavity filter the center conductor is usually ¼ wave length long requiring a low loss junction between the center conductor and one end, top or bottom, of the cavity where connection is ordinarily made. Since a ¼ wave length center conductor requires a direct physical contact, using a ¼ wave length center conductor made of a superconductor would pose serious electrical and mechanical connection problems due to the direct contact with a non-superconducting material forming the outer conductor of the cavity. A microwave cavity filter having at least superconductors in the inner conductor of the cavity that does not require direct contact with non-superconducting materials that substantially reduces ohmic losses would be an improvement over the prior art.

SUMMARY OF THE INVENTION

There is provided herein a microwave cavity filter comprised of a housing that is generally cylindrical with superconducting resonator elements within the housing that are selected to be approximately ½ as long as the wave length of a signal injected into the cavity. These ½ wave-length resonators shape the response of the cavity filter depending upon their length and are formed by quartz tubes coated with superconductor and positioned orthogonal to the top and bottom of the outer cavity. A suitable coolant is pumped through the quartz tubes keeping the temperature of the superconductor appropriate.

An RF input terminal and an RF output terminal positioned with respect to the superconducting resonator to adjust the desired amount of coupling between the RF input terminal and RF output terminal. Additional superconducting resonators may be positioned within the cavity having different resonant frequencies to adjust the frequency response of the filter as desired.

Portions of the cavity filter surrounding the resonators and within the cavity are evacuated to assist in maintaining the low temperature required for superconductivity of the resonators material.

Using ½ wave length center resonators eliminates the need for direct contact with either the top or the bottom of the cavity housing eliminating the possibility of excessive heat build up in the superconductor from external non-superconducting surfaces.

DETAILED DESCRIPTION OF THE PREFERRED EMBODIMENT

Figure 1:
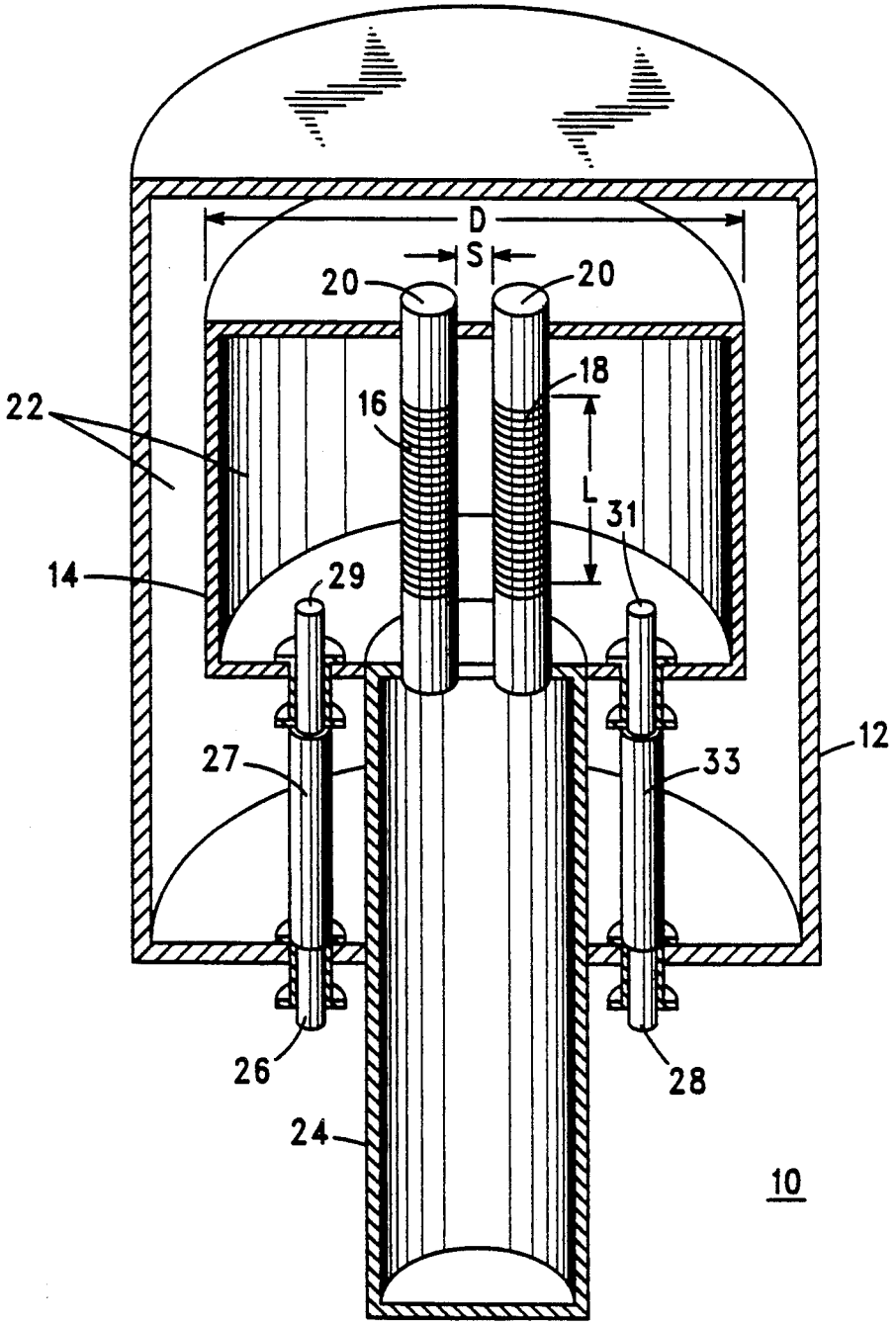
FIG. 1 shows a cross sectional diagram of the superconducting filter of the preferred embodiment.

FIG. 1 shows a cross-sectional view of a superconducting filter (10). The superconducting filter (10) is comprised of an outer enclosure (12) which is typically at room temperature enclosing an evacuated space (22) to thermally isolate interior portions of the filter (10). A copper outer conductor of the cavity resonator (14) encloses two quartz tubes (20), which are cylinders, are plated with superconducting material (16) along a predetermined length (L) of the outside surface of the quartz tube (20). (Quartz tubes were used because quartz is a dielectric material that has high thermally conductivity and very low dielectric loss although other dielectric materials having similar characteristics could be used as well.) The quartz tubes (20) are mounted substantially orthogonal to the substantially planar top and bottom surfaces of the cavity resonator (14). The superconducting material on the quartz tube (20) has a length (L) chosen to be equal to or very nearly equal to ½ the wave length of the desired resonant frequency of the filter (10).

RF microwave energy is transferred into the interior portion of the cavity of the filter by means of an input connection (26). A coaxial cable-like conductor (27) carries the RF energy to a coupling probe (29) having an empirically determined length and location to accomplish the desired coupling of the input signal at connector (26) to the output connector (28).

Output RF signals are picked up by a second coupling probe (31), also having a predetermined length and position to effect the desired coupling response. RF energy from the coupling probe (31) is carried to the output terminal (28) through a second coaxial type conductor (33) similar to a conventional coax cable.

The amount of coupling and the frequency response of the filter is determined largely by the number of resonator elements (16 and 18), the spacing (S) between the resonator elements with respect to each other as well as their spacing between the input probe (29) and the output probe (31), and their length (L). If multiple superconducting resonators have resonant frequencies that are slightly different, the response of the band pass filter (10) may begin to resemble the response of a well known Chebychev filter response. Alternatively, if the superconducting resonators (16 and 18) have identical ½ wave length resonate frequencies the response of the filter (10) may resemble a Butterworth response.

When the conductors of the resonators (16 and 18) are superconducting materials, the size of the inner conductors may be substantially reduced permitting the reduction of the diameter (D) of the outer conductor as well. In addition to reducing the size of the filter (10) by using superconducting inner conductor resonators (16 and 18), the cavity filter (10) may be designed to have unloaded Q factors in excess of 100,000. Using superconducting resonators will also substantially lower ohmic losses permitting smaller transmitting stations to be used with equivalent output power compared to that both systems use in prior art.

In the preferred embodiment the resonator elements (16 and 18) were comprised of quartz tubes (20) plated with appropriate superconductors such as Ytrium-Barium-Copper-Oxide. The outer conductor (14) which functions as a heat shield and as a vacuum barrier was made of copper. The outer enclosure (12) may be copper or other suitable material which also acts as a heat shield and a vacuum barrier for the filter.

A cryogenic pump expander (cryopump expander) (24) permits the passage of coolant through the interior of the cryopump expanded into the first superconducting resonator or the second superconducting resonator (18) as desired. The Cryopump expander (24) merely permits cooling fluid to access the interior portions of the quartz tubes (20).

What is claimed is:

1. In a microwave cavity filter comprised of an evacuated substantially cylindrical housing with an RF input terminal and an RF output terminal, the cavity filter preferentially coupling RF energy at at least one preferred frequency to the RF output terminal, an improvement comprising:

at least one dielectric cylinder mounter within said evacuated substantially cylindrical housing, said dielectric cylinder having a superconducting material coating at least a portion of the exterior of said dielectric cylinder, coolant for said superconducting material being transported through only the interior of said cylinder, said dielectric cylinder and superconducting material thereon forming a superconducting resonator element within said substantially cylindrical housing coupling RF energy from the RF input terminal to the RF output terminal, said at least one superconducting resonating element establishing the resonant frequency of the filter, the filter frequency response, and RF power coupling between the RF input and the RF output terminals.

2. The cavity filter of claim 1 where said portion of at least one dielectric cylinder is substantially one-half the wavelength of a signal present in said housing.

3. The cavity filter of claim 1 where said at least one dielectric cylinder is quartz.

4. The cavity filter of claim 1 where said housing is a closed cylinder having a substantially planar top and bottom.

5. The cavity filter of claim 4 where said at least one dielectric cylinder is substantially orthogonal to said planar top and bottom.

6. The cavity filter of claim 5 including means for transferring coolant through said cylindrical housing and housing to said dielectric cylinder.

7. The cavity filter of claim 6 where said means for transferring coolant through said cylindrical housing and housing to said dielectric cylinder is a cryopump expander.

* * * * *